US005570544A

United States Patent [19]

Hale et al.

[11] Patent Number: 5,570,544

[45] Date of Patent: Nov. 5, 1996

[54] INFLATABLE STRUCTURE

[76] Inventors: Gary A. Hale, 820 Birch St.; Troy A. Hale, 815 Long St., both of Haines, Oreg. 97833

[21] Appl. No.: 337,077

[22] Filed: Nov. 10, 1994

[51] Int. Cl.[6] ..... E04H 15/20; E04B 1/34

[52] U.S. Cl. ..... 52/218; 52/2.11; 52/640; 52/653.2

[58] Field of Search ..... 52/2.11, 2.13, 52/2.18, 2.21, 2.26, 640, 641, 653.2; 135/95, 115, 119, 128, 151; 5/455, 449; 297/380, 452.41; 403/5; 441/40, 41

[56] References Cited

U.S. PATENT DOCUMENTS

| | | | |
|---|---|---|---|
| 2,591,829 | 4/1952 | Katzenmeyer et al. | 52/2.21 |
| 2,623,574 | 12/1952 | Damsch | 297/380 X |
| 2,875,771 | 3/1959 | Brewin | 52/2.11 |
| 3,054,124 | 9/1962 | Silverstone | 52/2.21 X |
| 4,197,681 | 4/1980 | Holcombe . | |
| 4,862,906 | 9/1989 | Jordon | 135/95 |
| 4,959,901 | 10/1990 | Parish . | |
| 5,205,086 | 4/1993 | Heim | 52/2.18 X |
| 5,247,768 | 9/1993 | Russo | 52/2.25 X |
| 5,269,623 | 12/1993 | Hanson | 52/2.18 X |

FOREIGN PATENT DOCUMENTS

| | | | |
|---|---|---|---|
| 36051 | 9/1981 | European Pat. Off. | 52/2.18 |
| 511129 | 3/1959 | Italy | 52/2.18 |
| 491990 | 9/1938 | United Kingdom | 297/380 |
| 791695 | 3/1958 | United Kingdom | 52/2.18 |
| 2104934 | 3/1983 | United Kingdom | 52/2.18 |

OTHER PUBLICATIONS

Zumro Emergency Shelter Brochure, no date given.
Zumro Decon Shelter Brochure, no date given.

*Primary Examiner*—Wynn E. Wood
*Assistant Examiner*—Kevin D. Wilkens
*Attorney, Agent, or Firm*—Klarquist Sparkman Campbell Leigh & Whinston, LLP

[57] ABSTRACT

Inflatable, air supported frames may be employed to support a variety of structures, including tents. The inflatable frames are composed of one or more elongated inflatable air chambers to which are coupled plural restraints that prevent full extension of components of the frame upon inflation. The restraints cause the inflated frame to kink and form an angle at the location of the restraints. Consequently, the restraints work to define angled portions of the frame. The restraints may be adjusted to alter the configuration of the frame. As a result, one can stabilize the structure on uneven terrain or to cause the frame to assume multiple conformations.

20 Claims, 3 Drawing Sheets

INFLATABLE STRUCTURE

FIELD OF THE INVENTION

The present invention pertains to the field of inflatable tents and similar structures.

BACKGROUND OF THE INVENTION

A variety of inflatable structures have been described in the art. These inflatable structures include devices in which the tent sheathing or sheeting is itself inflatable, as in a cellular arrangement, or in which the sheathing is unitary with spaced-apart inflatable frame cells. Alternately, the structures comprise an inflatable frame covered by the sheathing. Examples of such structures are discussed in U.S. Pat. No. 4,197,681 (Holcombe) and U.S. Pat. No. 4,959,901 (Parish).

The inflatable structures in the prior art often have inadequate load bearing capacity and thus are prone to slouch or collapse when loaded with a heavy snow, for example. In addition, all bends in these structures are pre-formed, making them relatively complicated and expensive to manufacture. The prior art inflatable structures also lack versatility as they are designed to assume a single fixed configuration when inflated. Therefore, a need exists for an improved inflatable frame and structure.

SUMMARY OF THE INVENTION

The present invention provides inflatable, air supported frame elements and frames that may be employed in a variety of structures, including tents.

One embodiment of the present invention is an inflatable frame member for a structure comprising an elongated inflatable air chamber; an air inlet in communication with the air chamber through which the air chamber may be inflated; and a restraint coupled to the air chamber so as to prevent full extension of the chamber upon inflation such that the air chamber kinks and forms an angle at the location of the restraint. The restraint, which in one preferred form is an elongated strap, generally has a first portion coupled to the chamber at a first location, a second portion coupled to the chamber at a second location, and a spanning section extending between the first and second locations, with the distance between the first and the second locations being greater than the length of the spanning section. The restraint is preferably located on the exterior of the air chamber. The restraint is preferably adjustable, allowing one to adjust the length of the spanning section, and thereby the angle formed in the air chamber. As a result, the structure may be stabilized upon uneven terrain or adjusted to cause the frame member to assume one of multiple configurations.

The inflatable frame member may also include an optional pressure release valve in communication with the air chamber for limiting air pressure within the air chamber, allowing one to rapidly and safely inflate the air chamber to its optimal pressure without the fear of overinflation and possible damage to the inflatable frame.

The present invention also provides structures having an inflatable frame, the inflatable frame comprising plural inflatable elongated frame sections interconnected to form, when inflated, a framework. In a preferred embodiment, the framework includes a ridge element, at least one top plate element, at least one sole plate element, a plurality of rafter elements extending between the top plate element and the ridge element; a plurality of upright stud elements extending between the sole plate element and the top plate element; and plural restraints coupled to the frame so as to prevent full extension of the frame upon inflation, such that the frame kinks and forms an angle at the location of each of the restraints.

In a preferred form of wall tent, the restraints are each positioned adjacent to the top plate and extend generally from a lower end of a respective rafter element and the upper end of a stud element. Preferably, the structure further includes transversely extending cross pieces interconnecting the rafter elements to add stability to the structure. The top and sole plate elements are preferably generally horizontal, parallel, and transversely spaced apart.

Although such a structure may be formed from inflatable frame members having plural air inflation chambers, in the most preferred form of the invention, the structure is a single air chamber. The structure further comprises an optional pressure release valve in communication with the air chamber for limiting the pressure of air within the air chamber. The structure may further comprise a flexible covering.

When in the form of a frame for a walled tent, the structure preferably comprises a pair of transversely spaced apart sole plate elements and a pair of transversely spaced apart top plate elements. Preferably, the space between the respective top plate elements in this structure is bracing-free and the space between the respective sole plate elements is likewise bracing-free.

In an alternative embodiment, the frame is in the form of a six-sided structure for a pup tent or the like.

It is therefore an object of the present invention to provide a safer, more reliable inflatable structure combining simplicity of design, ease of use, and an improved load-bearing capability.

These and other objects, features and advantages of the invention will be understood more clearly by reference to the following description and drawings.

DETAILED DESCRIPTION OF PREFERRED EMBODIMENTS

The construction and operation of the present invention and the method of its use can best be understood by reference to the drawings and the following detailed description of several preferred embodiments.

The present invention provides an inflatable, air supported frame that may be employed to support a variety of structures, including tents.

The inflatable frames of the present invention are composed of one or more elongated inflatable air chambers, which are of a durable puncture restraint material, such as 19-002 neoprene-coated nylon from Mann Industries.

Restraints are coupled to the inflatable frame at selected locations where the frame is to kink and form an angle in the frame. Although the restraints may take a number of forms and may be internally positioned within the frame structure, a specific form of restraint is indicated at 10, as shown in FIGS. 1–4, and most specifically in detail in FIG. 4.

Figure 4:
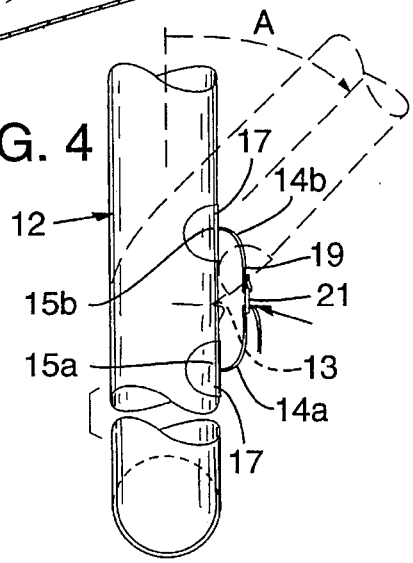
FIG. 4 is a view of one form of a restraint used to form an angle upon inflation of the chamber.

With reference to FIG. 4, the restraint 10 is coupled to a portion of an air chamber 12 so as to prevent full extension of the air chamber upon inflation, thus causing the air chamber to bend or kink, as indicated at 13, and form an angle at the location of the restraint.

The illustrated restraint 10 has a first portion 14*a* which is coupled to the air chamber 12 at a first location 15*a*. The restraint 10 also has a second portion 14*b* coupled to the air chamber at a second location 15*b*. The restraint may be coupled to the air chamber by a solvent weld or by any other means known in the art, including, but not limited to, sewing or gluing. The restraint is typically a flexible relatively inelastic element such as a nylon strap 19. Reinforcement patches 17, preferably of the same material as the air chamber, are secured to the air chamber at the locations 15*a*, 15*b*, to reinforce the air chamber at the connection locations for the restraint portions 14*a*, 14*b*.

The angle A at the location of the restraint is thus defined by length or span of the restraint in comparison to the distance along the air chamber between the first and the second coupling locations 15*a*, 15*b*. The shorter the length of the restraint for a given distance, the greater the angle A and vice versa.

Although not required, preferably the length of the restraint is adjustable. In the case of a restraint comprised of a strap 19, a length adjustment mechanism, such as a buckle 21, is used to permit the adjustment of the length of the strap between connection points 15*a*, 15*b*. Preferably, a lightweight material such as plastic is used for the buckle. Other adjustable fastening approaches may be used, such as VELCRO fastener material, to interconnect strap segments to form a strap of the desired length. By adjusting the strap length, the angle A is changed. Similar restraints are, in the illustrated embodiment, employed at selected locations (for example, at the rafter element/stud element/top plate element locations and at the rafter/ridge/rafter element locations). By adjusting the lengths of the restraints, the angles between components at the location of the restraints may be altered to, for example, stabilize the frame even though the terrain may be uneven, such as on a hillside.

By adjusting the length of the restraint, one can thus change this angle A or even eliminate the angle, if desired. Small adjustments can therefore readily be made in order to stabilize the structure on uneven terrain. Larger adjustments may also be made, such as, for example, to change the number and position of the bends. As a result, a single frame can be adjusted to assume more than one form. For example, by eliminating the bends between the rafter elements and stud elements in the frame shown in FIG. 2, the illustrated tent may readily be converted into an "A" frame. Other configurations may also be assumed.

The use of restraints to form angles in the air chamber 12 reduces the required number of pre-formed joints or bends required in the inflatable frame. This makes the manufacture of an inflatable frame of the present invention less complicated and reduces the manufacturing cost.

Figure 2:
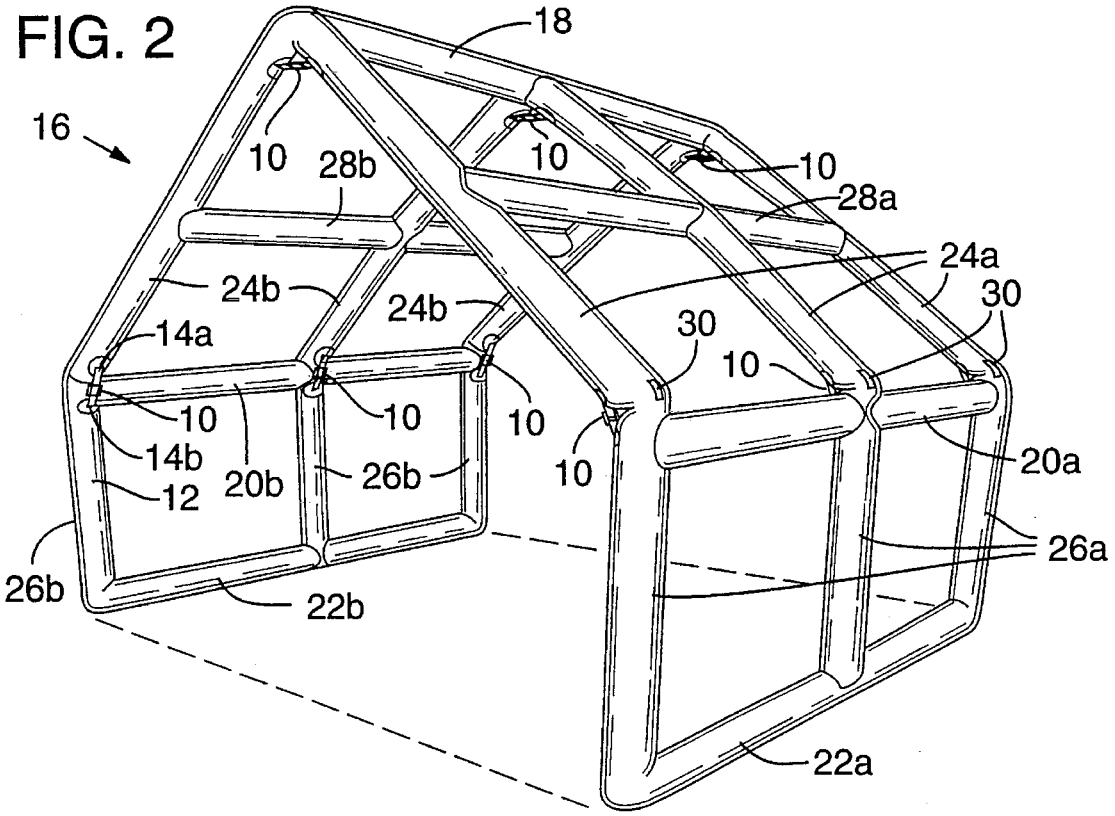
FIG. 2 is an inflatable frame for the tent of FIG. 1.

Referring again to the specific inflatable tent frame of FIG. 2, the framework 16 is constructed from generally cylindrical flexible tubing which is interconnected to form a single air chamber comprised of plural inflatable elongated frame sections. When inflated, the illustrated frame includes the following frame sections: a ridge element 18; a pair of transversely spaced apart top plate elements 20*a*, 20*b* which are preferably horizontal and parallel; a pair of transversely spaced apart sole plate elements 22*a*, 22*b* which are preferably horizontal and parallel; a plurality of rafter elements 24*a*, 24*b* extending between the respective top plate elements 20*a*, 20*b* and ridge element 18; a plurality of generally upright stud elements 26*a*, 26*b* extending between the respective sole plate elements 22*a*, 22*b* and top plate elements 20*a*, 20*b*; and a plurality of transversely extending cross pieces, in this case elements 28*a*, 28*b*, interconnecting the respective rafter elements.

VELCRO fastener material patches 30, or other optional fasteners, on the rafter elements, for example at a location adjacent to the top plate elements, are used to secure a covering to the tent frame. Other means known in the art for securing such a covering to the tent frame may be employed.

Preferably the space in the plane between the respective top plate elements 20*a*, 20*b* and in a plane between the respective sole plate elements 22*a*, 22*b* is bracing-free, as shown in FIG. 2. This lack of bracing at these locations is advantageous in a number of respects. For example, the lack of bracing facilitates entry into and exit from the structure as one need not stumble or step over such bracing; allows the frame, when deflated, to lie flat for easy storage; and does not constrain the angles between the side walls and rafters, allowing these angles to be easily adjusted, if desired. Because of this relatively simple frame construction, the inflatable frame constitutes a support for inexpensive, sturdy, stable, and adaptable structures.

Figure 3:
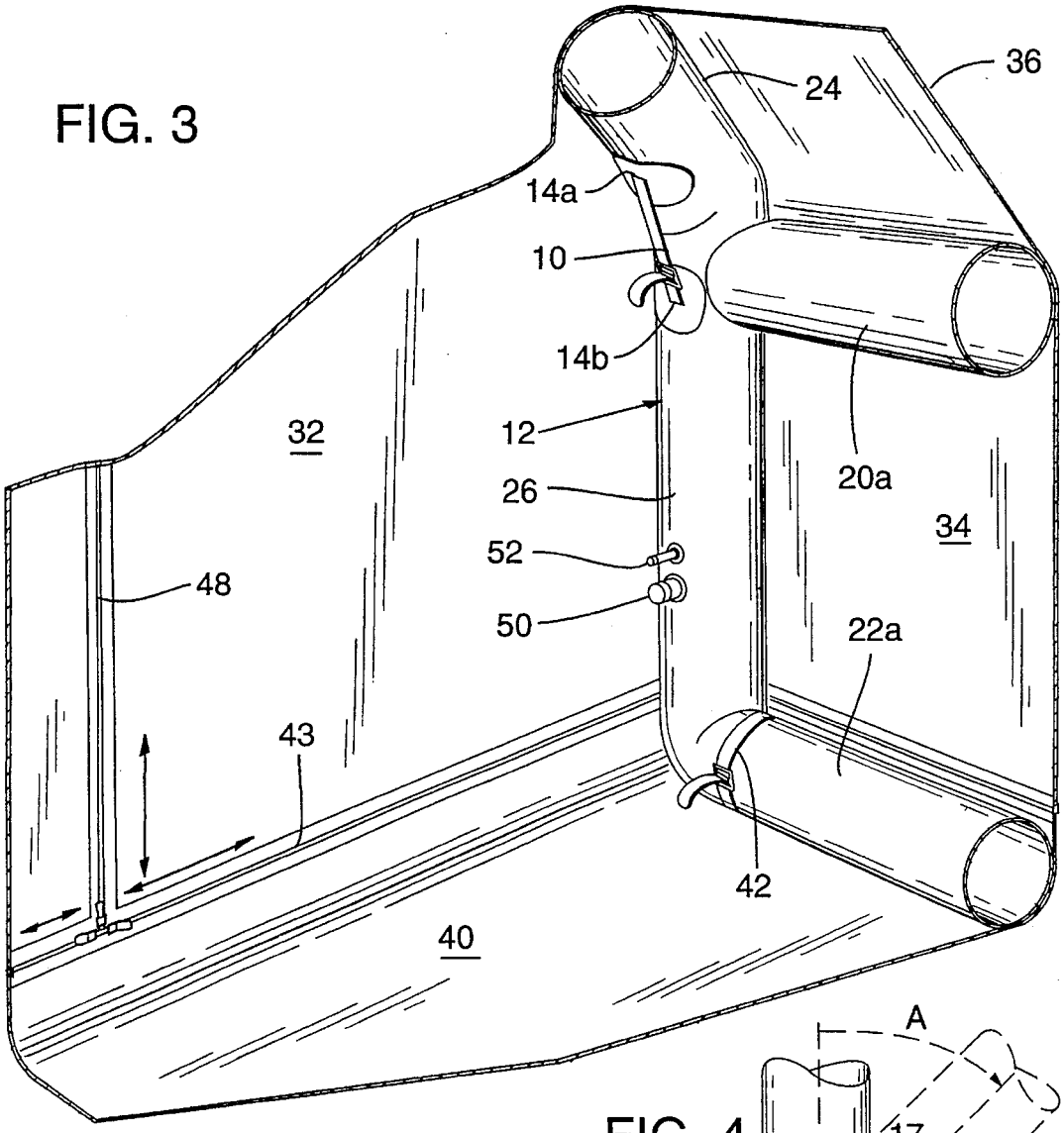
FIG. 3 is an enlarged view of an interior corner of the tent of FIG. 1.

In order to use the inflatable frame as a tent, the frame is covered with a covering 38, as shown in FIG. 3. Alternatively, the covering may be present on the interior of the frame and suspended from the frame. The covering is preferably flexible and separable, for example using a zipper 43, at the intersection between a floor 40 and side and end walls of the tent. Consequently, the floor may readily be removed, for example for cleaning purposes. In the case of a tent, the covering is preferably a fabric that is light weight, heavy duty, fire retardant and waterproof. Any of the flexible coverings known in the art for such purposes may be employed. Specific examples include ANSOTEX urethane coated nylon in weights ranging from 200 denier to 950 denier, preferably with heavier weight fabric for the floor of the tent and CORDURA ripstop-type fabric.

As shown in FIG. 3, the tent in the illustrated configuration has two end sections or walls 32, two side sections or walls 34, and roof sections 36 extending upward at an angle from the respective side sections to meet at a ridge. The end wall sections are optionally made of two panel sections selectively secured together, as by a zipper 48 (shown at one end wall in FIG. 1) to define an opening for ingress and egress. The end walls may also be selectively secured to the roof and side walls, for example, by a zipper (not shown). Consequently, the end walls may be removed in the same manner as the floor. This also permits replacement of an end wall of one material with a different material (such as mesh fabric). This also permits two tents to be joined together, utilizing the end wall zippers, allowing the removal of the end walls, for example, to form a larger tent. The seams of the tent sections are typically stitched together, although any suitable seam sealing approach may be used. The side walls may be parallel, as shown in FIG. 3, or sloping, depending upon the adjustment of restraints 10. Also, only one side wall may be sloped, if desired, and the structure may be configured as a lean-to.

Figure 5:
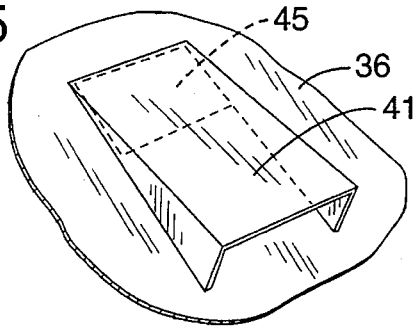
FIG. 5 is a top view of an optional air circulation vent for the tent of FIG. 1.

Vents 41 may be incorporated into the flexible covering to facilitate air circulation inside the tent. Preferably each vent comprises a screened or mesh-covered opening overlayed by a flap. The flap is typically of the same material as is used to form the roof of the tent. An air circulation vent 41 is shown in greater detail in FIG. 5. In FIG. 5, the roof opening is indicated at 45. The sides of the vent flap are of a generally triangular shape and are reinforced to stand up from the tent roof to facilitate air circulation to the vent opening. For example, triangular pieces of open cell foam (not shown) may be same size as, and glued or otherwise secured to, the sides of the vent flap for reinforcing purposes.

There are, in addition, a plurality of tie-downs 42 for use in securing the tent to the ground. It is preferred that there be minimum of one tie-down at or near each corner of the tent frame. In a preferred embodiment, each tie down comprises a flexible strap which encircles the sole plate element (see FIGS. 1 and 3) and passes through a slot in the covering of the tent. The tent cover opening through which the tie-down passes is preferably a button-hole type opening which may be closed, e.g., by stitching. The exterior portion of the tie-down extends outward and away from the tent and forms a loop, through which a tent stake can be driven into the ground, thus anchoring the tent. By coupling the tie-down directly to the frame, that is by encircling the frame with a strap, stresses arising during use of the tent, for example as a result of wind loading, are resisted by the frame and are not borne solely by the fabric covering. Additional tie-downs, not shown, such as fabric loops at the corners and center of the tent at the top plate level, are also typically used.

Preferably, in addition to the covering described above, an additional layer of mesh fabric may be provided as a screen at the front of the tent, which may be closed (e.g., zipped) while the outer covering is open to provide ventilation and simultaneously exclude insects. For a day tent or dining tent for warm weather use, the covering may comprise a first portion covering the roof made from a fabric or the like with a second portion covering the side and end walls made from a mesh material to allow air circulation while excluding insects.

As mentioned above and shown in greater detail in FIG. 3, a first zipper 43, for example a #10 plastic zipper made by American Plastic, extends horizontally around the perimeter of the tent and is used to selectively attach the floor 40 to the flexible covering forming the side walls 34 and end walls 32. FIG. 3 also shows the zipper 48 at the front end wall 32 extending vertically from the floor toward the ridge. When zipper 48 is open, the tent is accessible.

As shown in FIG. 3, the inflatable frame has an air inlet 50, preferably a standard inflate/deflate valve (for example, a series 690 valve made by Halkey-Roberts). The frame also preferably includes a pressure relief valve 52 (for example a series 780 valve from Halkey-Roberts) which limits the maximum pressure in the inflated frame. Consequently, one can rapidly and safely inflate the air chamber to its optimal pressure without overinflation. The air inlet and pressure relief valves are preferably located on an upright stud element 26 (for example, between sole and top plate elements 20*a*, 22*a*) closest to an end wall to allow easy access for inflating and deflating the tent. The inflate/deflate and pressure relief valves are also preferably disposed on the air chamber 12 so as to face the interior of the structure defined by the frame. Consequently, the valves are easily accessible for inflation of the frame while preventing friction between the valves and a fabric covering. If plural air chambers are included in the frame, each air chamber is provided with an inflate/deflate valve and optionally may be provided with a pressure relief valve.

Figure 1:
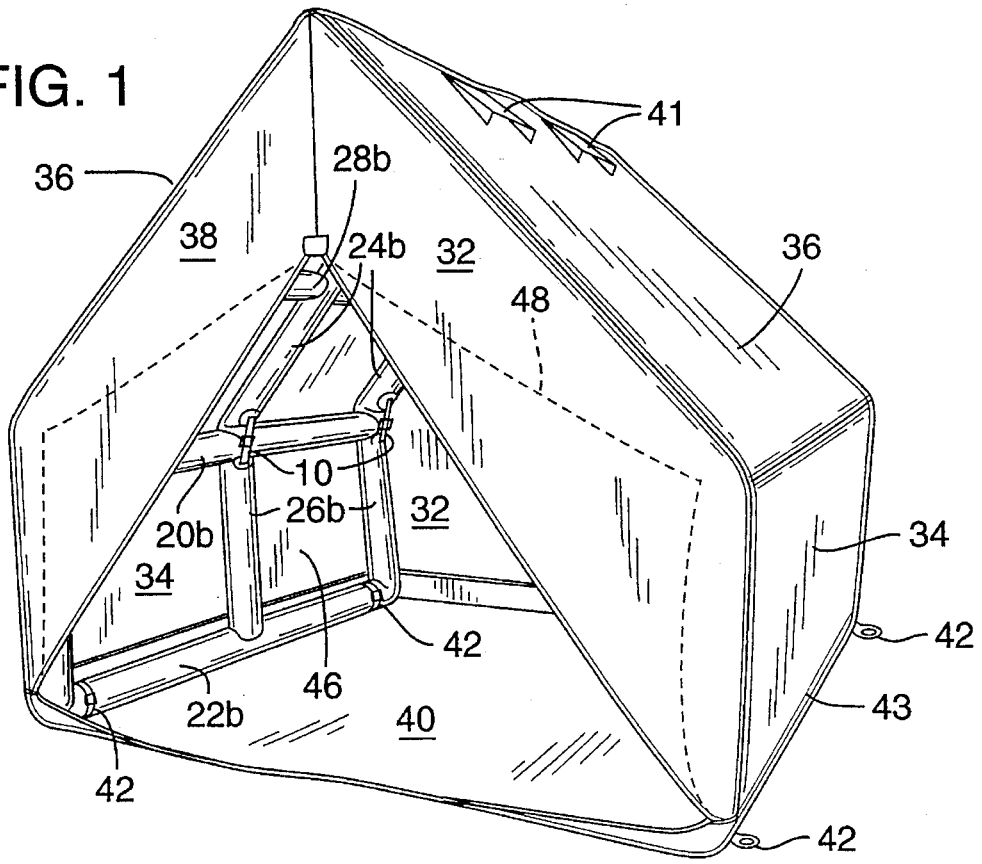
FIG. 1 is a perspective view of one form of an inflatable frame-supported structure in accordance with the present invention configured as a tent.

When deflated, the frame may be folded and/or rolled for storage, preferably without removing the flexible covering. The tent may be inflated using a conventional hand pump, such as a double action hand pump. A tent as shown in FIG. 1, can be deflated and stored in a duffle bag. To set up the tent, one simply removes the tent (the deflated frame with surrounding covering), locates the inflate/deflate valve, and inflates the frame until air begins to escape from the pressure relief valve. The tent is thus fully inflated with the surrounding cover.

Figure 6:
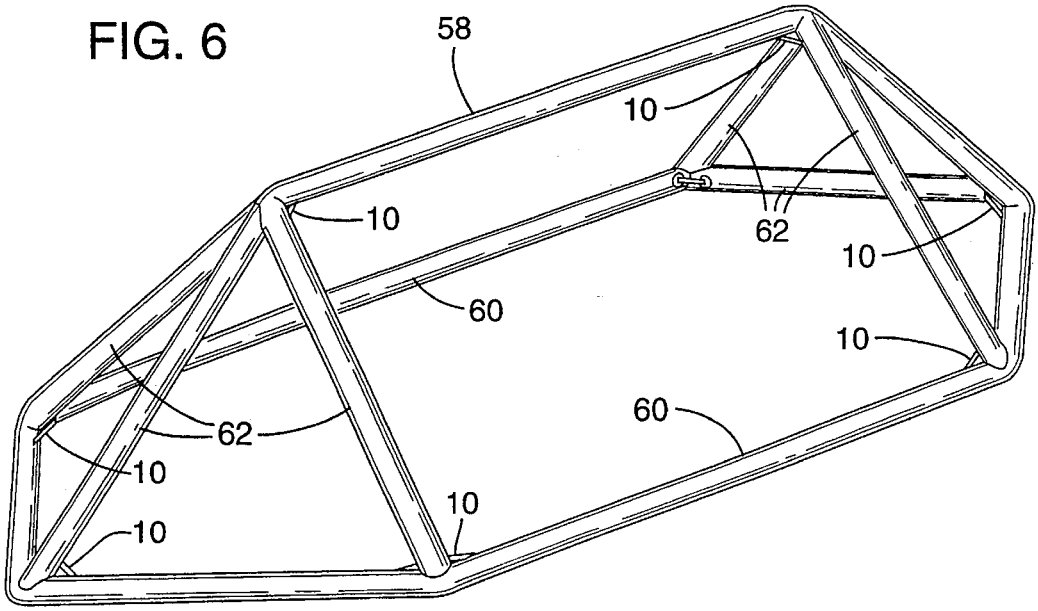
FIG. 6 is a perspective view of an inflatable frame for a pup tent.

The inflatable frames of the present invention may also be used for tents of other configurations, such as frames for small, lightweight pup tents, as shown in FIG. 6. The pup tent frame is preferably constructed from generally cylindrical flexible tubing (for example, neoprene-coated nylon) which is interconnected to form a single air chamber comprising plural inflatable elongated frame sections. The angles of the pup tent frame are defined by restraints 10, such as described above. The inflatable frame has an air inlet, typically a standard inflate/deflate valve, and, preferably, a pressure relief valve (not shown).

When inflated, the illustrated pup tent frame includes the following frame sections: a ridge element 58; a pair of base elements 60; and a plurality of side wall elements 62 extending between the base elements and ridge element. In the illustrated preferred embodiment, the frame has two ends, each end having three side wall elements 62 that are joined together at one end of the ridge element 58. The base 60 also joins the lower ends of the side wall elements. The frame thus defines a pup tent frame having the configuration of an elongated prism with generally pyramidal ends, as shown in FIG. 6.

Figure 7:
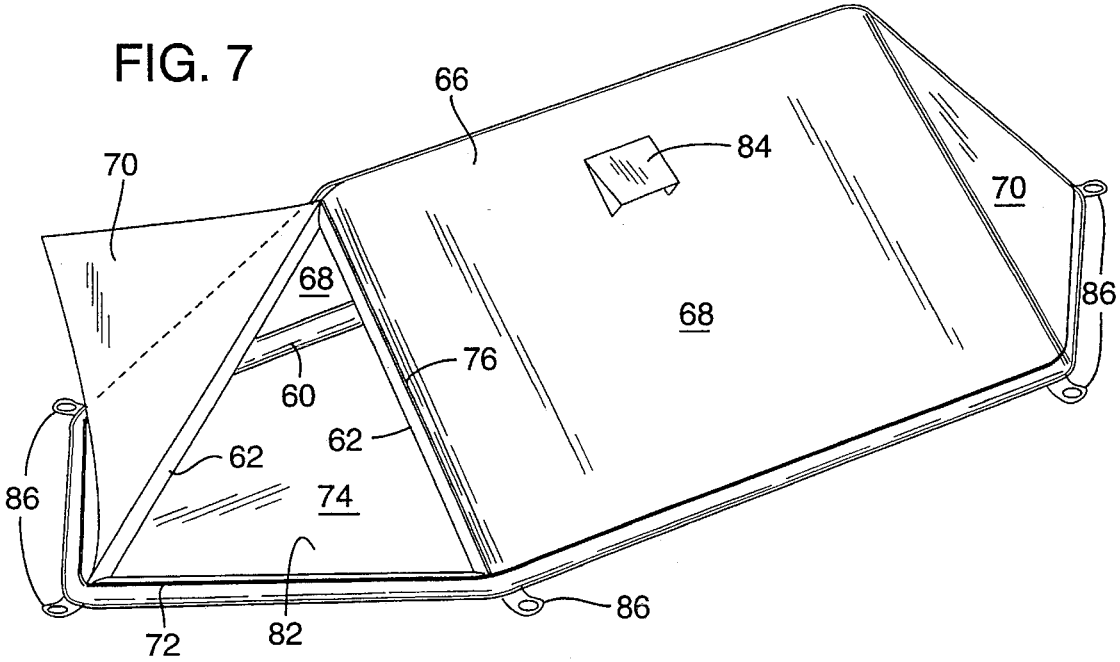
FIG. 7 is a perspective view of the frame of FIG. 6 with a covering.

The pup tent frame with a flexible covering 66 is shown in FIG. 7. As shown, the pup tent has two generally rectangular side walls 68, four triangular end walls 70, two at each end of the tent, and a floor 74. A first horizontal zipper 72 extends horizontally about the perimeter of the tent and selectively attaches the floor 74 to the flexible covering forming the side walls 68 and end walls 70. Another zipper 76 at one end of the tent is opened to provide a doorway leading to the interior of the tent.

Optional air circulation vents 84, like vent 41, are preferably located at an upper region of each side wall of the pup tent. Tie downs 86, which may be like tie downs 42 in FIG. 1, are typically used and may be located at each of the six corners of the pup tent.

Preferably, the pup tent is inflated using a hand pump. A preferred hand pump is a small, lightweight foot pump, such as a Sevylor U.S.A. 2041 pump. A lightweight pup tent as shown in FIG. 7, can be deflated and stored, along with a lightweight foot pump, in a small carrying case, which may take the form of a slightly oversized fanny pack.

Each of the zippers of the tents are preferably covered by an overlying flap (not shown) to keep out the wind and rain.

Having illustrated and described the principles of the invention in several preferred embodiments, it should be apparent to those skilled in the art that the invention can be modified in arrangement and detail without departing from such principles. We claim all modifications coming within the spirit and scope of the following claims.

We claim:

1. An inflatable frame member for a structure comprising an elongated inflatable air chamber;

an air inlet in communication with the air chamber through which the air chamber is inflated; and an adjustable restraint coupled to the air chamber so as to prevent full extension of the chamber upon inflation such that the air chamber kinks and forms an angle at the location of the restraint, whereby adjustment of the restraint adjusts the angle.

2. An inflatable frame member according to claim 1 wherein the restraint has a first portion coupled to the chamber at a first location, a second portion coupled to the chamber at a second location, and having a section with a length which extends between the first and second locations, the distance between the first and the second locations being greater than the length of the section.

3. An inflatable frame member according to claim 2 wherein the air chamber has an exterior and an interior and the first and second locations are at the exterior of the chamber.

4. An inflatable frame member according to claim 1 further comprising a pressure release valve in communication with the air chamber for limiting air pressure within the air chamber.

5. An inflatable frame member for a structure comprising:

an elongated inflatable air chamber;

an air inlet in communication with the air chamber through which the air chamber is inflated; and an elongated strap coupled to the air chamber so as to prevent full extension of the chamber upon inflation such that the air chamber kinks and forms an angle at the location of the strap.

6. An inflatable frame according to claim 5 wherein the strap has an adjustable length.

7. A structure having an inflatable frame, the inflatable frame comprising plural inflatable frame sections interconnecting to form, when inflated, a framework including a ridge element, at least one top plate element, at least one sole plate element, a plurality of rafter elements extending between the top plate element and the ridge element, and a plurality of upright stud elements extending between the sole plate element and the top plate element; and an adjustable restraint coupled to the frame so as to prevent full extension of the frame upon inflation, such that the inflatable frame kinks and forms an angle at the location of the restraint, whereby adjustment of the restraint adjusts the angle.

8. A structure according to claim 7 wherein the framework further includes transversely extending cross pieces connecting the rafter elements.

9. A structure according to claim 7 wherein the top and sole plate elements are generally horizontal, parallel, and spaced apart.

10. A structure according to claim 7 wherein there are a pair of transversely spaced apart sole plate elements and a pair of transversely spaced apart top plate elements and wherein the plane defined by the top plate elements and the plane defined by the sole plate elements are bracing-free.

11. A structure according to claim 7 further comprising a flexible covering.

12. A structure according to claim 7 in which the inflatable frame includes a single air chamber.

13. A structure according to claim 12 further comprising a pressure release valve in communication with the air chamber for limiting the pressure of air within the air chamber.

14. A structure having an inflatable frame, the inflatable frame comprising:

a single air chamber having an exterior and an interior, the air chamber comprising plural inflatable elongated frame sections interconnecting to form, when inflated, a framework including: a ridge element, a pair of sole plate elements and a pair of top plate elements, wherein the top and sole plate elements are generally horizontal, parallel, and spaced apart and wherein the plane defined by the top plate elements and the plane defined by the sole plate elements are bracing-free; a plurality of rafter elements extending between the top plate element and ridge element; a plurality of upright stud elements extending between the sole plate elements and top plate elements; and a plurality of transversely extending cross pieces connecting the rafter elements;

plural elongated straps of adjustable length, each strap having a first portion coupled to the exterior of the chamber at a first location, a second portion coupled to the exterior of the chamber at a second location, and a section with a length that extends between the first and second locations, the distance between the first and the second locations being greater than the length of the section so as to prevent full extension of the chamber upon inflation, such that, upon inflation, the frame chamber kinks and forms an angle at the location of the restraint; and a pressure release valve in communication with the air chamber for limiting the pressure of air within the air chamber.

15. An inflatable frame member for a structure comprising:

an elongated inflatable air chamber having a plurality of sections that lack a preformed bend;

an air inlet in communication with the air chamber through which the air chamber is inflated; and a restraint coupled to each section such that, upon inflation of the chamber, the restraint prevents full extension of the section to which it is coupled and causes the section to which it is coupled to kink and form an angle, and wherein the restraint has an adjustable length and adjustment of the restraint adjusts the angle.

16. An inflatable frame member according to claim 15 wherein the restraint is an elongated strap.

17. An inflatable frame member for a structure comprising:

an elongated inflatable air chamber having a section lacking a preformed bend;

an air inlet in communication with the air chamber through which the air chamber is inflated; and a restraint coupled in a non-surrounding relationship to the air chamber such that, upon inflation of the chamber, the restraint prevents full extension of the section and causes the section to kink and form an angle and wherein the restraint has an adjustable length and adjustment of the restraint adjusts the angle.

18. An inflatable frame member according to claim 17 wherein the restraint is an elongated strap.

19. An inflatable structure comprising:

an inflatable frame comprising: (a) an elongated inflatable air chamber having a section lacking a preformed bend; (b) an air inlet in communication with the air chamber through which the air chamber is inflated; and a restraint coupled to the section such that, upon inflation of the chamber, the restraint prevents full extension of the section and causes the section to kink and form an angle;

a flexible covering, wherein kinking of the section of the frame is independent of the flexible covering; and wherein the restraint has an adjustable length and adjustment of the restraint adjusts the angle.

20. An inflatable structure according to claim 19 wherein the restraint is an elongated strap.

* * * * *